US007611073B2

(12) United States Patent
Crutcher

(10) Patent No.: US 7,611,073 B2
(45) Date of Patent: Nov. 3, 2009

(54) TALKING FAUCET FOUNTAIN

(76) Inventor: William C. Crutcher, 84 Munson Rd., Middlebury, CT (US) 06762

( * ) Notice: Subject to any disclaimer, the term of this patent is extended or adjusted under 35 U.S.C. 154(b) by 0 days.

(21) Appl. No.: 12/036,223

(22) Filed: Feb. 23, 2008

(65) Prior Publication Data

US 2009/0212123 A1 Aug. 27, 2009

(51) Int. Cl.
*B05B 12/14* (2006.01)

(52) U.S. Cl. ..... 239/25; 239/24; 239/72; 239/211; 239/289; 340/540

(58) Field of Classification Search ..... 239/24–27, 239/71, 72, 211, 289; 340/540
See application file for complete search history.

(56) References Cited

U.S. PATENT DOCUMENTS 4,934,597 A 6/1990 Crutcher
4,936,508 A * 6/1990 Ingalz ..... 239/72
5,337,956 A 8/1994 Crutcher
5,482,078 A 1/1996 Yeh
5,542,604 A * 8/1996 Ferren ..... 239/289
6,359,559 B1 * 3/2002 Rudell et al. ..... 340/540

* cited by examiner

*Primary Examiner*—Steven J Ganey

(57) ABSTRACT

An injection-molded faucet fountain core attachable to a water faucet with a manually actuated flap to selectively direct water from an outlet for drinking and incorporating a programmable battery-operated sound emitting device. The faucet fountain core is enclosed by a jacket having an external character face or shape. The sound emitting device is programmed to make sounds or voices that are compatible with the character or shape on the faucet fountain jacket. The character and voice may be changed by programming the sound emitting device and changing the external jacket.

6 Claims, 2 Drawing Sheets

TALKING FAUCET FOUNTAIN

BACKGROUND OF THE INVENTION

Figure 1:
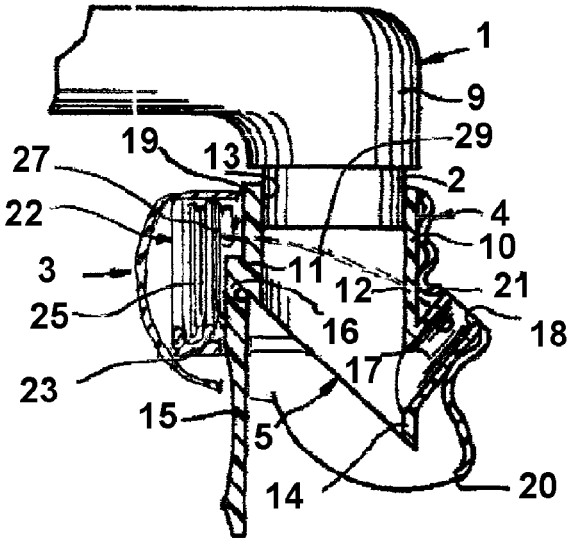

This invention relates generally to faucet fountains adapted for attachment to faucets for drinking and having fanciful objects or characters with human-like or animal-like features for entertaining children. More particularly the invention relates to an improved construction of such faucet fountains having provision for making sounds or voices that are compatible with the fanciful object or character on the faucet fountain.

Faucet fountains have been proposed for attachment to faucets or aerators connected to the faucets, which permit normal usage of the faucet, and which also permit alternate use by manual manipulation of a closure member to obtain a flow of drinking water from a spout. Such a fountain has been proposed in U.S. Pat. No. 4,934,597 issued Jun. 19, 1990 to William C. Crutcher, said patent being incorporated herein by reference. This fountain comprised a tubular body with a front wall portion and a rear wall portion, the tubular body having an inlet end adapted to frictionally fit over a faucet and having an outlet end, a closure member attached to the rear wall portion adjacent the outlet end and of sufficient size to cover the outlet end, and a fountain conduit extending upwardly and outwardly from a hole defined in the front wall portion near the outlet end of the tubular body to a terminating spout end, the closure member being arranged to be moved to cover the outlet end to direct water from the faucet through the spout end. The subject patent preferably employed an integral plastic body and closure member with a living hinge. The type of faucet fountain mold described above, preferably a high volume injection mold, is very expensive. If it is desired to embellish the exterior of the faucet fountain with fanciful character features, a new mold would be required each time a new character is needed.

On the other hand, there are inexpensive molding techniques available for molding sculptures of character faces, enabling complex exterior surfaces on hollow shapes. One technique uses rotational casting of plastic using inexpensive molds, introducing the plastic into the mold interior and rotating it while the plastic cures. The exterior surface of the hollow plastic casting may duplicate a fanciful character figure, face or scene, which is enhanced by painting features onto the exterior surface. Such techniques and plastics are not suitable for manufacturing a faucet fountain, but very adaptable to changing from one fanciful object or character face to another. A faucet fountain has been proposed in U.S. Pat. No. 5,337,956, issued Aug. 16, 1994 to William C. Crutcher that combines a jacket depicting a character or fanciful object placed over a faucet fountain core to create a combination toy and faucet fountain, said patent being incorporated herein by reference.

While the aforesaid combination creates an economical way to create a large variety of characters or fanciful objects, there are many times that sounds are closely associated with characters, or when it would be amusing to create a voice or sound when the faucet fountain is actuated. For example, animals are associated from childhood with well-known sounds, e.g. mooing cows, grunting pigs, meowing cats and barking dogs. Also, popular animated characters sometimes are associated with verbal phrases such as the "Cowabunga" of the Teenage Mutant Ninja Turtles or "What's up, Doc" of Bugs Bunny. It would add to the utility of a faucet fountain having such a character to sound out the favorite phrase of that character when the fountain is activated. Also traditional holiday characters, such as a Halloween witch on a faucet fountain would have added utility if augmented with a witches cackle when the fountain is activated.

A faucet toy, which is not a fountain, has been produced by the Taiwan company Lucky Star, and described in U.S. Pat. No. 5,482,078 issued Jan. 9, 1996 to Yeh. In this toy, an animal sound mechanism is activated by a stream of water from the faucet as it passes through an animal head affixed to the faucet. However, this toy suffers from the fact that the sound is always activated whenever the faucet is turned on, because it is activated by the main water stream.

It would be desirable to have a faucet fountain with a sound producing mechanism that is only activated when using the faucet fountain, but which is not activated when the faucet is turned on for normal use. It would also be desirable to have a character faucet fountain that emits a sound associated with a particular character when the fountain is used.

Accordingly one object of the present invention is to provide a faucet fountain embellished with a fanciful object, such as a fanciful character face, which emits a sound associated with the character.

Another object of the invention is to provide an improvement in a toy faucet fountain which will appeal to children.

Still another object of the invention is to provide a talking faucet fountain which is economical to produce, and easy to convert to a number of different characters, using the same basic core and sound module configuration.

Another object of the invention is to provide a faucet fountain with a sound producing mechanism that is only activated when using the faucet fountain, but which is not activated when the faucet is turned on for normal use.

SUMMARY OF THE INVENTION

Briefly stated, the invention is practiced by providing a talking faucet fountain comprising a faucet fountain core including a tubular body having an inlet end adapted to frictionally fit over a faucet and having an outlet end, a movable closure member of sufficient size to cover the outlet end, and a fountain conduit extending upwardly and outwardly from the body to a terminating spout end, the closure member being arranged to be moved to cover the outlet end to direct water from the faucet through the fountain conduit to the spout end. The faucet fountain core includes a receptacle disposed at the back of the tubular body opposite the fountain conduit. The receptacle houses a battery-powered sound emitter with a loud speaker and a printed circuit board including a programmable memory for the sound and having two switch terminals, the sound emitter being arranged to initiate a sound when the switch is momentarily closed. The switch terminals are connected to two contact terminals located in the fountain conduit so as to come in contact with the water stream passing through the fountain conduit. A jacket encloses the receptacle, the tubular body and the fountain conduit. The jacket is arranged to accommodate movement of the closure member while permitting water to flow from the fountain conduit. The jacket has a molded exterior surface depicting at least one fanciful object which may comprise the likeness of a fanciful character face with features including eyes, nose and mouth molded therein. Movement of the closure member directs water through the fountain conduit to close the switch and initiate a sound at the same time as the water flows from the fountain conduit so that it appears to come from the object, as well as being available for drinking.

DRAWING

Figure 2:
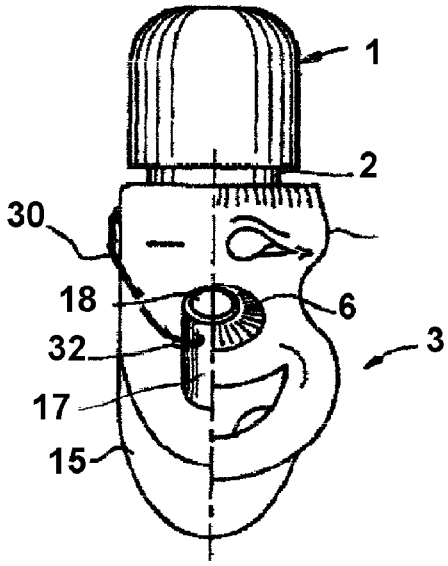
Figure 3:
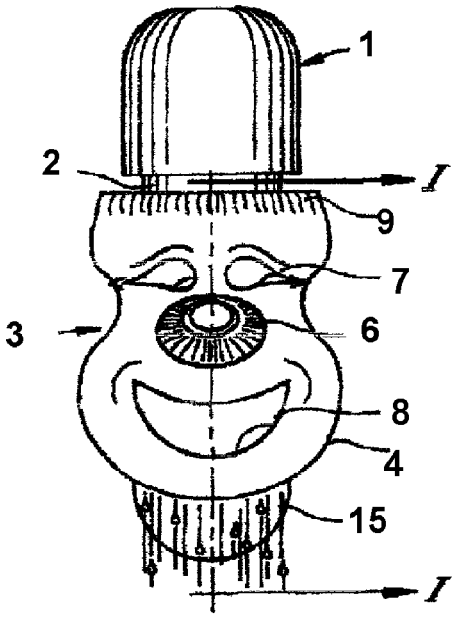
Figure 4:
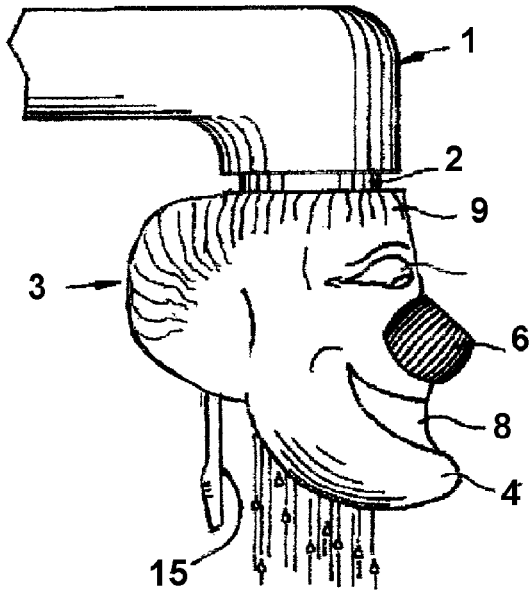
Figure 5:
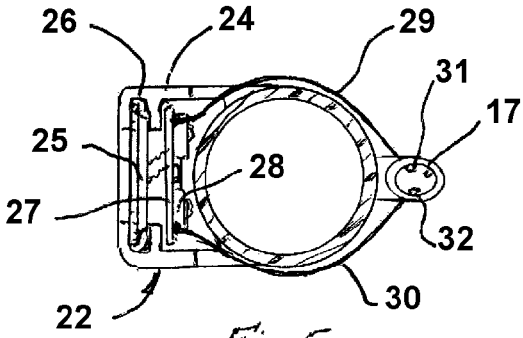
Figure 6:
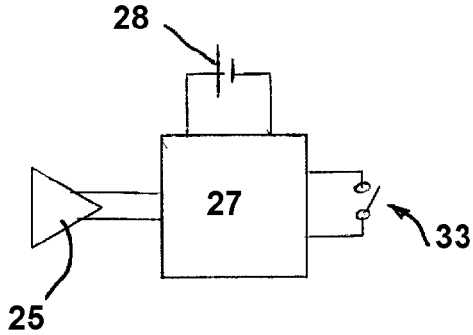
Figure 7:
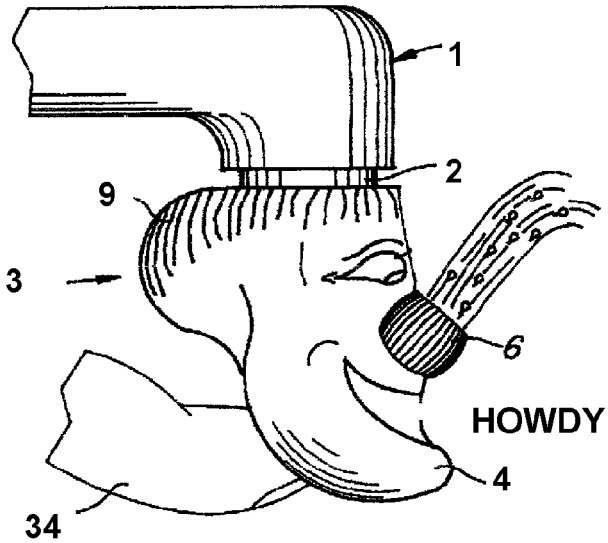

The objects of the invention will be better understood by reference to the following description, taken in connection with the accompanying drawings, in which:

FIG. 1 is a side elevational view in cross-section, taken along lines I-I of FIG. 3, and illustrating a talking faucet fountain core disposed inside a jacket, and attached to a water faucet, FIG. 2 is a front elevational view of FIG. 1 with the jacket removed from one half of the figure to show the fountain core with sound module switch wiring connected in accordance with the present invention, FIG. 3 is a front elevational view of the combination toy and faucet fountain attached to a faucet with water running from the faucet in normal use without using the fountain, FIG. 4 is a side elevational view of FIG. 3, FIG. 5 is a top plan view of FIG. 1 with the jacket removed, FIG. 6 is a simplified schematic diagram of the sound module, and FIG. 7 is a side elevational view of the talking faucet fountain activated by the closure member for drinking and emitting a talking sound as water flows through the drinking spout.

DETAILED DESCRIPTION OF THE PREFERRED EMBODIMENT

Referring now to FIGS. 1 through 4 of the drawing, a water faucet 1, with an aerator 2, has attached thereto a combination toy and drinking fountain shown generally as 3. The toy/fountain 3 comprises a flexible plastic jacket 4 surrounding a faucet fountain core 5, but arranged to generally hide it from view. The jacket 4 is hollow and has a fanciful object molded on its exterior surface. Here the object is a nose 6 on the face of a clown. Other features are molded on the face such as eyes 7, mouth 8 and hair 9. The clown's face is painted on the exterior surface of the jacket.

Faucet fountain core 5 may be constructed according to the aforementioned U.S. Pat. No. 4,934,597 to comprise a tubular body 10 with a short rear wall portion 11, and a long front wall portion 12, preferably two to three times the length of the rear wall portion. The tubular body 10 has an inlet end 13 adapted to frictionally fit over the end of the faucet aerator 2, an outlet end 14, and a closure member 15 attached to the rear wall adjacent the outlet end 14. Closure member 15 may be injection molded as an integral part of the faucet fountain core 5, and joined to the tubular body by a thin section 16 serving as a living hinge. A fountain conduit 17 is molded as part of the faucet fountain core, which extends upwardly and outwardly from the tubular body 14 to a terminating spout end 18. The closure member 15 is of sufficient size and shape to cover the outlet end 14 and is arranged to be moved by pushing with a finger to cover the outlet end 14 and divert water through the fountain spout end 18 for drinking.

A jacket 4 is constructed and adapted to fit over the faucet fountain core. The jacket is hollow and molded by an inexpensive technique such as rotational casting. A master sculpture of a desired scene or character is fashioned using the exterior of the faucet fountain core as a base. A fanciful object such as a feature on an easily recognizable character's face, or an accessory utilized by an easily recognizable character, is located in the vicinity of the terminating spout end 18. In FIG. 2 the nose 6 of the clown's face is the fanciful object on the exterior of jacket 4 from which water will flow.

The jacket 4 is preferably of flexible plastic material, and defines a first opening 19 surrounding the inlet end 13 of the fountain core tubular body, a second opening 20 surrounding the outlet end of the fountain core tubular body, and a third opening 21 aligned with the terminating end of the fountain conduit. The second opening accommodates movement of the closure member 15. The third opening is located in the object on the jacket, here the clown's nose 6, so that the water appears to come from the clown's nose as well as being available for drinking. Preferably the first opening 19 of the flexible jacket is sized to frictionally grip the inlet end 13 of the tubular member by stretching the plastic to hold the jacket 4 in place. However, the jacket 4 may also be cast of rigid material and supported on the fountain conduit 17.

In accordance with the present invention, and referring also to FIG. 5, the faucet fountain core includes a receptacle shown generally at 22 disposed on the back side of the tubular body 10. Receptacle 22 has a bottom wall 23 that is divided into two sections, a lower portion and an upper portion. The receptacle 22 is seen to have side walls 24 and is open at the top and partially open at the back. A miniature speaker 25 is carried in grooves 26 in the side wall and bottom wall. A suitable speaker is a miniature 20 mm. speaker that is commercially available. A miniature sound emitter printed circuit board 27 is disposed in the receptacle 22. Circuit board 27 carries circuit elements including a programmable sound emitting chip (not shown) and also carries button cells 28 which are connected to power the circuit board. The techniques to design the printed circuit board and the programming of the sound-emitting chip to produce the desired sound are already known to those skilled in the art. The emitted sound may be a voice, an animal sound, music or any desired noise that is in character with the jacket depicting a fanciful object or character.

In order to activate the sound emitting module, a pair of conductors 29, 30 are led from the circuit board around core body 10 to spaced terminals 31, 32 respectively. These are located inside the fountain conduit 17 so that they are in contact with the water stream flowing through the conduit 17 when the fountain is in use. The water conducts a small current across the path between the spaced terminals 31, 32 and acts to close a switch activating the sound emitting chip.

Referring to FIG. 6 of the drawing, a simplified schematic diagram shows circuit board 27 omitting the circuit elements and sound emitting chip. Speaker 25 and button cells 27 are illustrated along with a switch 33 schematically representing an activating switch that is closed when water flows through the fountain conduit 17.

OPERATION

Referring first to FIGS. 1, 3 and 4, the faucet fountain does not interfere with normal operation of the faucet. As shown, the water simply flows through the tubular body 10 past the closure member 15 and out the outlet 14.

Referring to FIGS. 1, 5 and 7, when closure member is manually actuated with a finger, shown at 34, the water flow is diverted through the fountain conduit 17. The terminals 31, 32 are immersed in water whose conductivity closed switch 33. The switch may either trigger the sound emitter on, to terminate when the program times out, or it may operate to continuously emit sound for as long as the switch is closed. Either mode of operation is contemplated, wherein the sound commences when water flows through the fountain conduit 17. This is illustrated in FIG. 7 by having the clown speak the word "HOWDY" when the fountain is activated, this sound being associated with the clown character. To change to a new character, it is only necessary to have a new jacket and to program the sound emitting chip with a new sound associated with the character on the new jacket. It is not necessary to change the basic and expensive injection-molded faucet fountain core or the physical construction of the sound emitting device.

The invention may be extended to any character or animal face. It may also extend to a musical sound or melody associated with a fanciful object such as a musical instrument. All of the foregoing applications are comprehended within the term, "talking faucet fountain".

Other modifications will occur to those skilled in the art and it is desired to cover in the appended claims all such modifications as fall within the true spirit and scope of the invention.

The invention claimed is:

1. A talking faucet fountain comprising a faucet fountain core including a tubular body having an inlet end adapted to fit over a water faucet and having an outlet end, a movable closure member of sufficient size to cover said outlet end, and a fountain conduit extending upwardly and outwardly from the body to a terminating spout end, the closure member being hinged to and arranged to selectively cover the outlet end when manually actuated so as to divert a stream of water from the body through the fountain conduit to exit from said spout end, said faucet fountain core further including a receptacle disposed adjacent said body;

a battery-powered sound emitter disposed in said receptacle, said sound emitter having a loud speaker and a printed circuit board including a sound-emitting chip and a pair of switch terminals;

a pair of contact terminals arranged to be exposed to said stream of water, at least one of said contact terminals disposed inside said fountain conduit, said contact terminals connected to said switch terminals; and a jacket having a molded exterior surface depicting at least one fanciful object and enclosing said faucet fountain core, said jacket defining an inlet opening, an outlet opening and a spout opening arranged to receive, respectively, said inlet end, said outlet end and said spout end, said spout opening being disposed in said fanciful object, said jacket being arranged to accommodate movement of the closure member, whereby water may be selectively directed by manual actuation of the closure member to flow through the fountain conduit over said contact terminals causing sound to be emitted from the loudspeaker as water exits said spout opening.

2. The talking faucet fountain according to claim 1, wherein said faucet fountain core, said receptacle and said closure member comprise a single plastic injection-molded member.

3. The talking faucet fountain according to claim 1, wherein said fanciful object is part of the face of a recognizable character and wherein said sound-emitting chip is programmable to emit sound associated with said recognizable character.

4. The talking faucet fountain according to claim 1, wherein respective ones of said pair of switch terminals are connected to respective ones of said pair of contact terminals by a pair of conductors led from said circuit board around said tubular body inside of said jacket.

5. A talking faucet fountain comprising a faucet fountain core including a tubular body having an inlet end adapted to fit over a water faucet and having an outlet end, a movable closure member of sufficient size to cover said outlet end, and a fountain conduit extending upwardly and outwardly from the body to a terminating spout end, the closure member being hinged to and arranged to selectively cover the outlet end when manually actuated so as to direct water from the faucet through the fountain conduit to said spout end, said faucet fountain core further including a receptacle disposed adjacent said body; said faucet fountain core, said receptacle and said closure member comprise a single plastic injection-molded member;

a battery-powered sound emitter disposed in said receptacle, said sound emitter having a loud speaker and a printed circuit board including a programmable sound-emitting chip and a pair of switch terminals;

a pair of contact terminals disposed inside said fountain conduit, said pair of switch terminals being connected to respective ones of said pair of contact terminals by a pair of conductors led from said circuit board around said tubular body inside of said jacket; and a jacket having a molded exterior surface depicting at least one fanciful object, said jacket enclosing said faucet fountain core and defining an inlet opening, an outlet opening and a spout opening arranged to receive, respectively, said inlet end, said outlet end and said spout end, said spout opening being disposed in said fanciful object, said jacket being arranged to accommodate movement of the closure member, whereby water may be selectively directed by manual actuation of the closure member to flow through the fountain conduit over said contact terminals causing sound to be emitted from the loudspeaker as water exits said spout opening.

6. A talking faucet fountain comprising a faucet fountain core including a tubular body having an inlet end adapted to fit over a water faucet and having an outlet end, a movable closure member of sufficient size to cover said outlet end, and a fountain conduit extending upwardly and outwardly from the body to a terminating spout end, the closure member being hinged to and arranged to selectively cover the outlet end when manually actuated so as to direct water from the faucet through the fountain conduit to exit from said spout end, said faucet fountain core further including a receptacle attached to the back side of said tubular body opposite said fountain conduit and having a bottom wall, side walls defining side wall grooves and a partially open back wall;

a battery-powered sound emitter disposed in said receptacle, said sound emitter having a loud speaker and a printed circuit board including a sound-emitting chip and a pair of switch terminals, said loud speaker being disposed in said side wall grooves and facing said back wall;

a pair of contact terminals disposed inside said fountain conduit, said contact terminals connected to said switch terminals; and a jacket having a molded exterior surface depicting at least one fanciful object and enclosing said faucet fountain core, said jacket defining openings at said inlet end, said outlet end and said spout end, said spout end being disposed in said fanciful object, said jacket being arranged to accommodate movement of the closure member, whereby water may be selectively directed by the closure member to flow through the fountain conduit over said contact terminals causing sound to be emitted from the loudspeaker as water exits said spout end.

* * * * *